US011491385B2

(12) United States Patent
Mattina

(10) Patent No.: US 11,491,385 B2
(45) Date of Patent: Nov. 8, 2022

(54) FOOTBALL YARDAGE CHAIN APPARATUS

(71) Applicant: Anthony Mattina, Diberville, MS (US)

(72) Inventor: Anthony Mattina, Diberville, MS (US)

( * ) Notice: Subject to any disclaimer, the term of this patent is extended or adjusted under 35 U.S.C. 154(b) by 499 days.

(21) Appl. No.: 16/667,137

(22) Filed: Oct. 29, 2019

(65) Prior Publication Data

US 2021/0121761 A1 Apr. 29, 2021

(51) Int. Cl.
*A63B 71/06* (2006.01)

(52) U.S. Cl.
CPC .... *A63B 71/0605* (2013.01); *A63B 2243/007* (2013.01)

(58) Field of Classification Search
CPC ..... A63B 71/0605; A63B 2243/007; A63B 71/06; A63B 2071/0625; A63B 2071/0627; A63B 2210/50; A63B 2220/805
USPC ..... 273/108, 247; 33/227, 263, 281, 282, 33/285, 286, 289, 755, 756, 623; 473/476–492, 227, 263, 281, 282, 285, 473/286, 289, 295, 755, 756, 623
See application file for complete search history.

(56) References Cited

U.S. PATENT DOCUMENTS 2,064,745 A * 12/1936 Harrie ..... A63B 71/0672 116/225
3,181,241 A 5/1965 Middleton
3,678,592 A 7/1972 Williamson
3,752,588 A * 8/1973 Chapman ..... A63B 71/0605 356/399
5,113,589 A * 5/1992 Randolph ..... G01C 15/06 33/295
5,189,803 A * 3/1993 Caywood ..... A63B 71/0605 40/598
6,851,198 B1 * 2/2005 Harty ..... A63B 71/0605 33/289
6,851,199 B1 * 2/2005 Zeitz ..... A63B 71/0608 273/317.5
7,481,003 B2 * 1/2009 Garza ..... A63B 69/002 33/289
7,770,297 B1 * 8/2010 Sommerfeld ..... A63B 71/0605 33/DIG. 21
8,220,170 B1 7/2012 Winckler
2019/0290992 A1 * 9/2019 Foster ..... A63B 71/0619

* cited by examiner

*Primary Examiner* — Nini F Legesse

(57) ABSTRACT

A football yardage chain apparatus for more accurately detecting first downs includes a unit housing having a pole aperture extending from a top side through a bottom side and a channel extending through to the pole aperture from proximal the bottom side to the top side. A pole is coupled through the pole aperture and a chain connector is coupled proximal a bottom end of the pole. A marker bar has a hinge coupled within the channel and swingingly moves between a stored position parallel with the pole and an alternative extended position configured to extend to a height proximal a nose of a football resting horizontally on the ground. A back side of the marker bar lies coplanar with a tangent plane of the pole at a point of union with the chain connector.

10 Claims, 6 Drawing Sheets

FOOTBALL YARDAGE CHAIN APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to American football yardage markers and more particularly pertains to a new American football yardage marker for more accurately detecting first downs.

BRIEF SUMMARY OF THE INVENTION

An embodiment of the disclosure meets the needs presented above by generally comprising a pole configured to conform to the dimensions of a standard lead American football yardage marker pole. A chain connector is coupled proximal a bottom end of the pole and extends perpendicularly from a tangent plane of an outer surface of the pole at a point of union of the chain connector and the pole. The chain connector is configured to couple to a chain coupled to a standard follow American football yardage marker pole. A unit housing is coupled to the pole and has a top side, a bottom side, and a middle portion extending therebetween. The top side has a pole aperture extending through the bottom side and a channel extending through an inner side of the middle portion to the pole aperture from proximal the bottom side to the top side. The pole is coupled within the pole aperture such that the chain connector is between the unit housing and the bottom end of the pole. A marker bar is coupled to the unit housing. The marker bar has a hinge coupled within the channel and swingingly moves between a stored position parallel with the pole and an alternative extended position. The marker bar in the extended position forms an angle 90° or greater with the pole and is configured to extend to a height proximal a nose of a football resting horizontally on the ground. A back side of the marker bar lies coplanar with the tangent plane at the point of union of the chain connector and the pole in both the stored position and the extended position.

An alternative embodiment of the disclosure meets the needs presented above by generally comprising a pole configured to conform to the dimensions of a standard lead American football yardage marker pole. A chain connector is coupled proximal a bottom end of the pole and extends perpendicularly from a tangent plane of an outer surface of the pole at a point of union of the chain connector and the pole. The chain connector is configured to couple to a chain coupled to a standard follow American football yardage marker pole. A unit housing is coupled to the pole and has a top side, a bottom side, and a middle portion extending therebetween. The top side has a pole aperture extending through the bottom side. The pole is coupled within the pole aperture such that the chain connector is between the unit housing and the bottom end of the pole. A marker laser is coupled within the middle portion and has a lens extending through an inner side of the middle portion. The laser forms a planar laser grid coplanar with the tangent plane at the point of union of the chain connector and the pole. A CPU is coupled within the middle portion and is in operational communication with the marker laser. The CPU is configured to detect when the planar laser grid is broken by a nose of a football. An alert system is coupled to the unit housing within the middle portion and is in operational communication with the marker laser and the CPU. The alert system is activated by the CPU when the planar laser grid is broken to provide an audio and or visual cue to a user. A battery is coupled within the middle portion and is in operational communication with the marker laser, the CPU, and the alert system.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
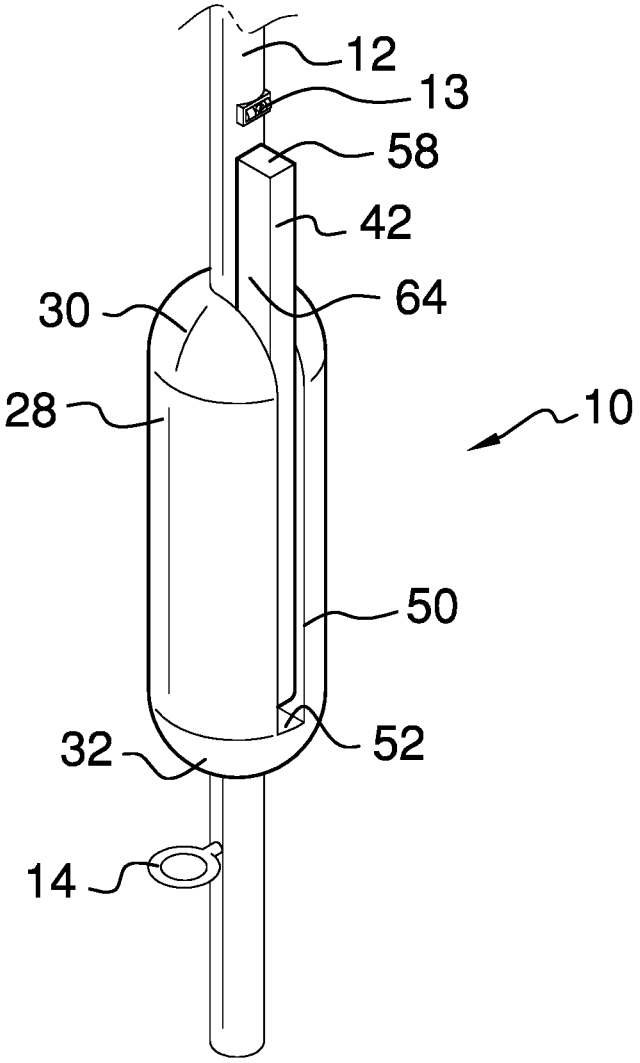
FIG. 1 is an isometric view of a football yardage chain apparatus according to an embodiment of the disclosure.
Figure 2:
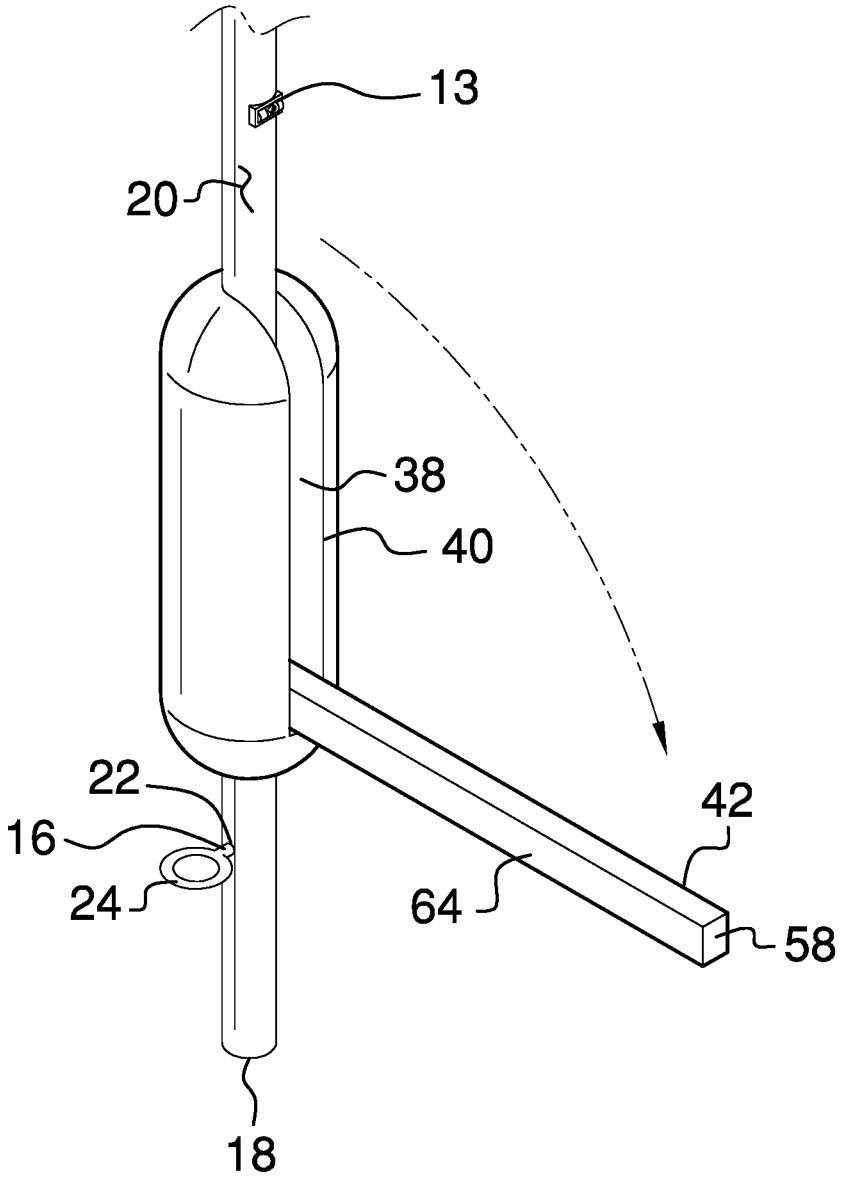
FIG. 2 is an isometric view of an embodiment of the disclosure.
Figure 3:
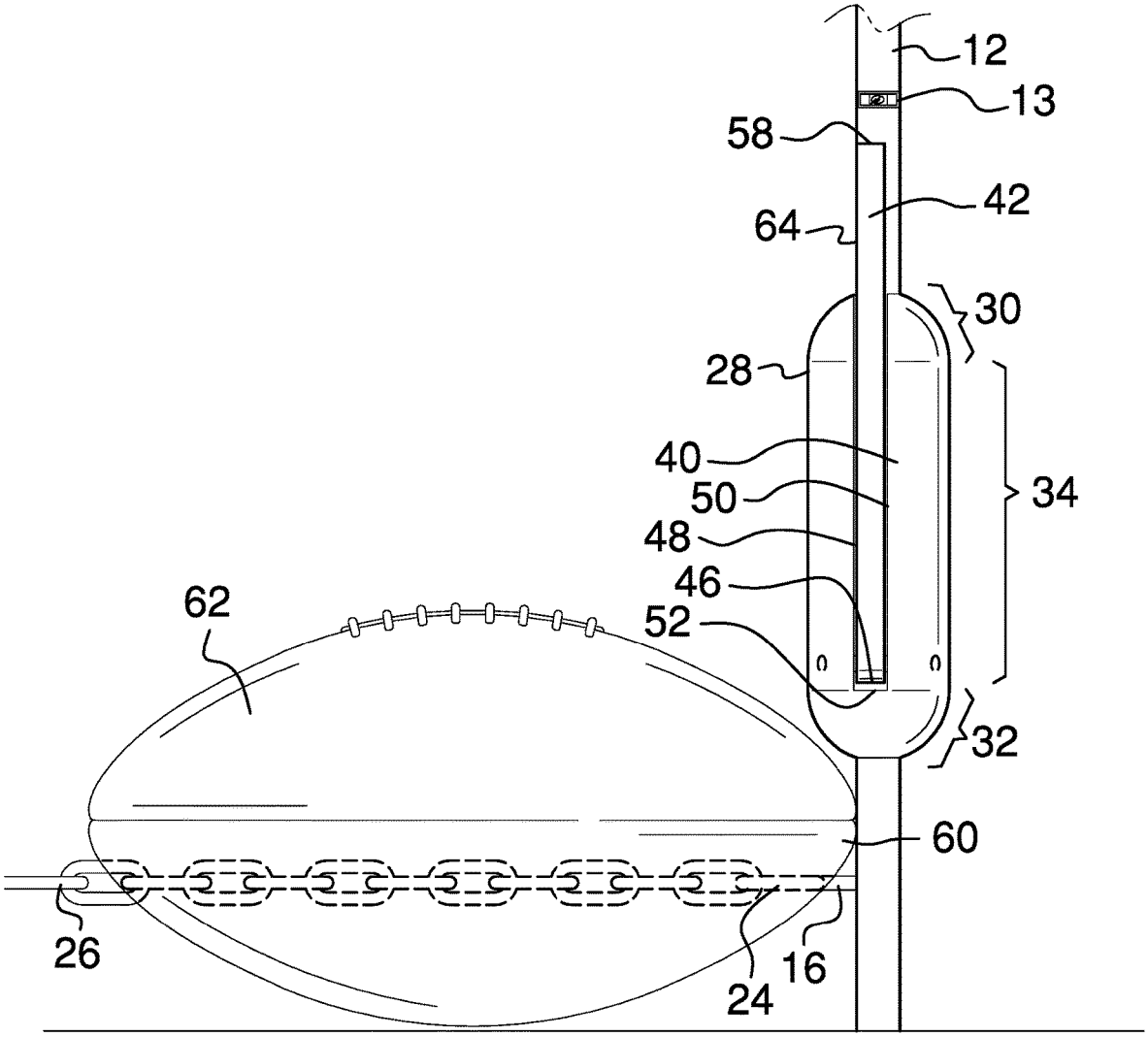
FIG. 3 is a side elevation view of an embodiment of the disclosure.
Figure 4:
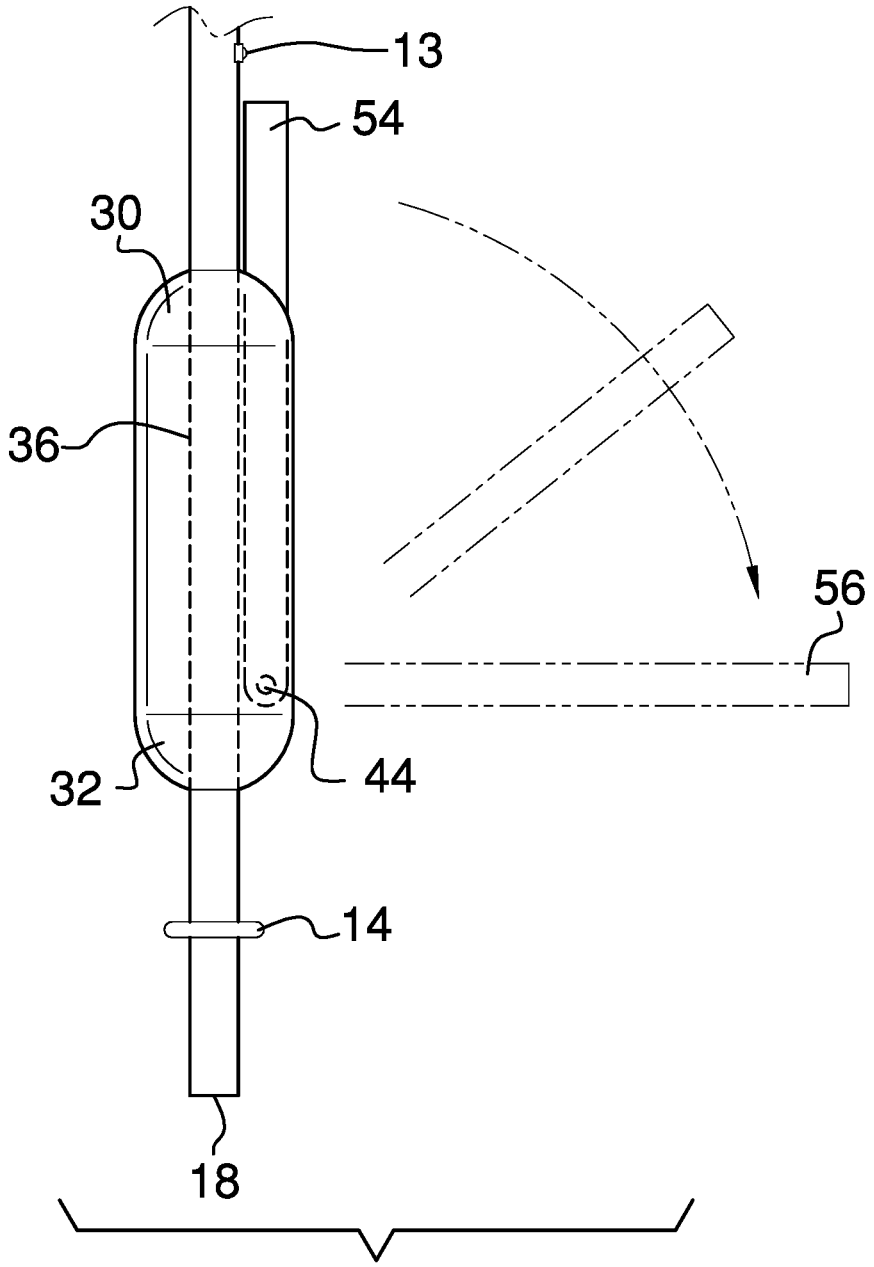
FIG. 4 is a rear elevation view of an embodiment of the disclosure.
Figure 5:
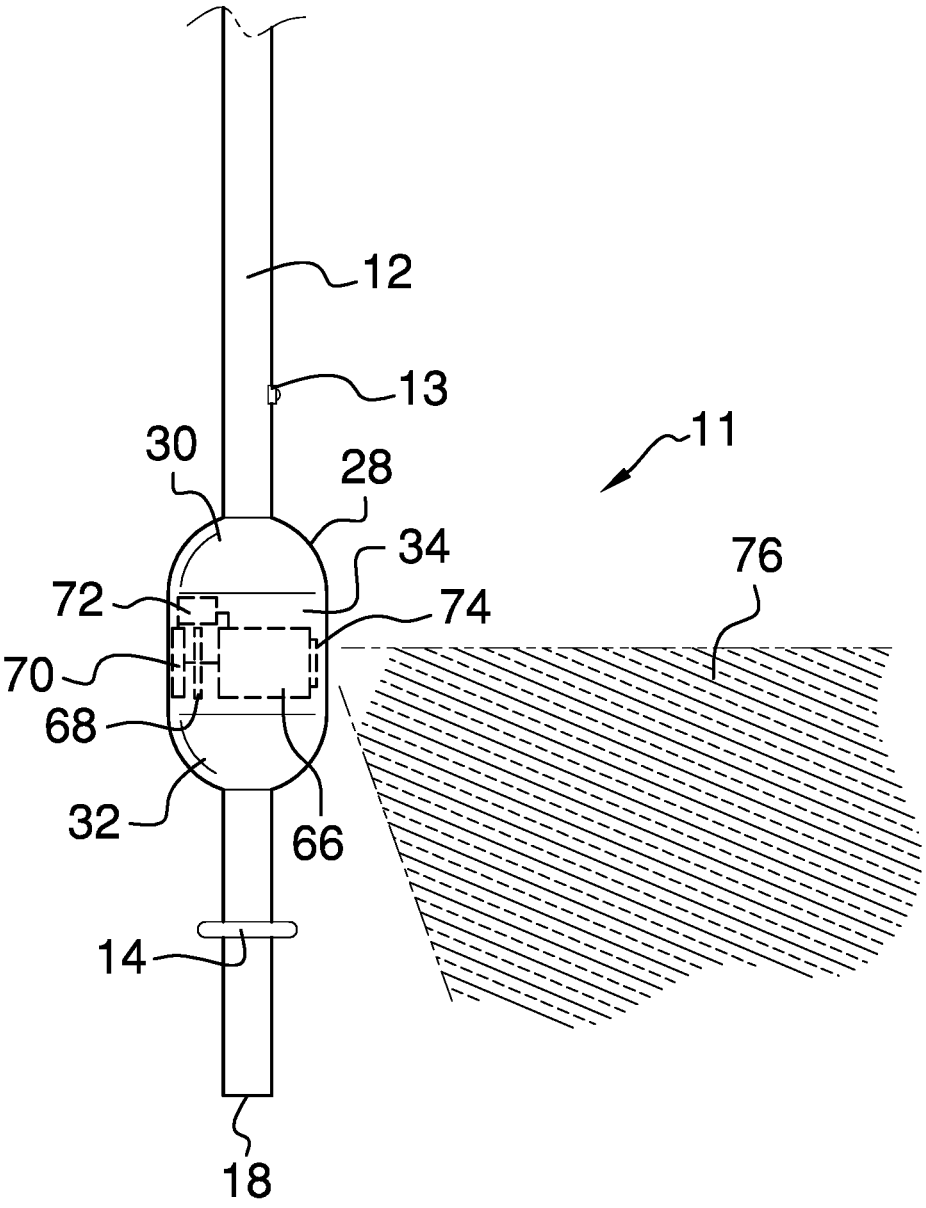
FIG. 5 is a front elevation view of an alternative embodiment of the disclosure.
Figure 6:
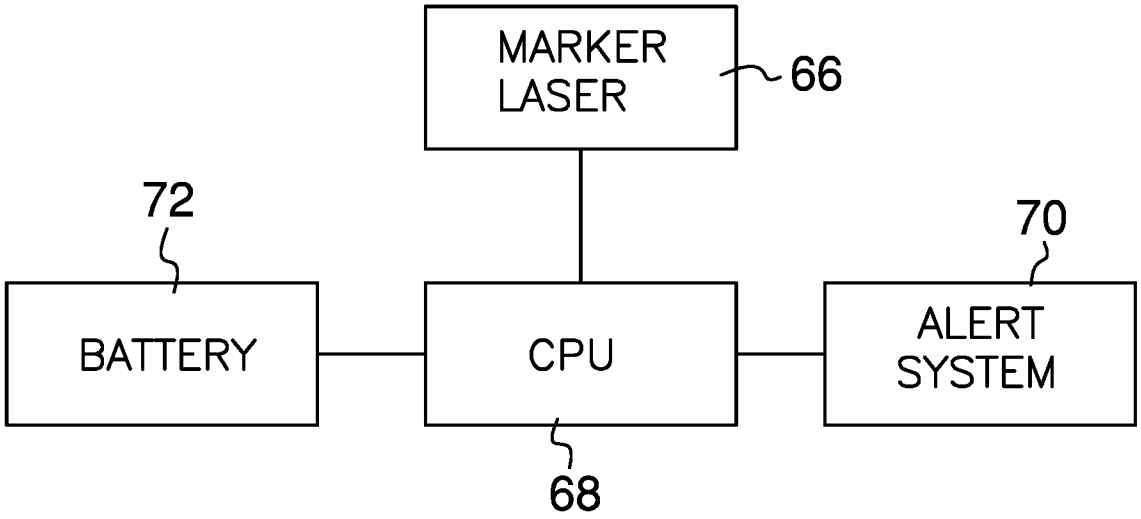
FIG. 6 is a block diagram of an alternative embodiment of the disclosure.

With reference now to the drawings, and in particular to FIGS. 1 through 6 thereof, a new American football yardage marker embodying the principles and concepts of an embodiment of the disclosure and generally designated by the reference numeral 10 will be described.

As best illustrated in FIGS. 1 through 6, the football yardage chain apparatus 10 generally comprises a pole 12 conforming to the dimensions of a standard lead American football yardage marker pole. A level 13 may be coupled within the pole 12 to ensure it is being secured vertically. A chain connector 14 has an extension 16 coupled to the pole 12 proximal a bottom end 18 of the pole and extends perpendicularly from a tangent plane of an outer surface 20 of the pole at a point of union 22 of the chain connector and the pole 12. The chain connector 14 has an eyelet 24 coupled to the extension 16 and configured to couple to a chain 26 coupled to a standard follow American football yardage marker pole. The eyelet 24 is circular and has a diameter configured to allow the chain 26 to move freely unless pulled taut. The eyelet 24 may lie in a plane parallel to a plane of the bottom end 18 and horizontal when in use.

A unit housing 28 is coupled to the pole 12. The unit housing 12 has a top side 30, a bottom side 32, and a middle portion 34 extending therebetween. The top side 30 has a pole aperture 36 extending through the bottom side 32 and a channel 38 extending through an inner side 40 of the middle portion 34 and the top side 30 to the pole aperture 36 from proximal the bottom side 32 to the top side 30. The top side 30 and the bottom side 32 of the unit housing are hemispherical and the middle portion 34 is cylindrical to eliminate edges on which a user can hit his shins. The pole 12 is coupled within the pole aperture 36 such that the chain connector 14 is between the unit housing 28 and the bottom end 18 of the pole.

A marker bar 42 is coupled to the unit housing 28. The marker bar 42 is rectangular prismatic and has a hinge 44 coupled through a rounded proximal end 46 and extending between a rear face 48 and a front face 50 adjacent a bottom face 52 of the channel. The marker bar 42 swingingly moves between a stored position 54 parallel with the pole 12 and an alternative extended position 56. A distal end 58 of the marker bar extends above the top side 30 of the unit housing in the stored position 54 to allow for easy manipulation by the user. The marker bar 42 in the extended position 56 forms an angle 90° or greater with the pole 12 and is configured to extend to a height proximal a nose 60 of a football 62 resting horizontally on the ground. The channel 38 secures the marker bar 42 between the rear face 48 and the front face 50 to require force to be moved between the stored position 54 and the extended position 56. A back side 64 of the marker bar lies coplanar with the tangent plane at the point of union 22 of the chain connector and the pole in both the stored position 54 and the extended position 56.

An alternative embodiment 11 does not have the channel 38 or the marker bar 42 but rather a marker laser 66, a CPU 68, an alert system 70, and a battery 72 coupled to the unit housing 12 within the middle portion 34. The marker laser 66 has a lens 74 extending through the inner side 40 of the middle portion. The marker laser 66 forms a planar laser grid 76 coplanar with the tangent plane at the point of union 22 of the chain connector and the pole. The CPU 68 is in operational communication with the marker laser 66 and is configured to detect when the planar laser grid 76 is broken by the nose 60 of the football. The alert system 70 is in operational communication with the marker laser 66 and the CPU 68 and is activated by the CPU 68 when the planar laser grid 76 is broken to provide an audio and or visual cue to the user. The battery 72 is in operational communication with the marker laser 66, the CPU 68, and the alert system 70.

In use, the pole 12 is manipulated like the standard lead American football yardage marker pole. To measure whether or not a first down has been achieved, the marker bar 42 is moved to the extended position 56 to check whether or not the nose 60 of the football has broken the tangent plane at the point of union 22 of the chain connector and the pole. The marker bar 42 is then returned to the stored position 54. The alternative embodiment 11 is merely placed in position proximal the football 62 to see whether or not the alert system 70 is activated.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A football yardage chain apparatus comprising:

a pole, the pole conforming to dimensions of a standard lead American football yardage marker pole;

a chain connector coupled to the pole, the chain connector being coupled proximal a bottom end of the pole and extending perpendicularly from a tangent plane of an outer surface of the pole at a point of union of the chain connector and the pole, the chain connector being configured to couple to a chain coupled to a standard follow American football yardage marker pole;

a unit housing coupled to the pole, the unit housing having a top side, a bottom side, and a middle portion extending therebetween, the top side having a pole aperture extending through the bottom side and a channel extending through an inner side of the middle portion to the pole aperture from proximal the bottom side to the top side, the pole being coupled within the pole aperture such that the chain connector is between the unit housing and the bottom end of the pole; and a marker bar coupled to the unit housing, the marker bar having a hinge coupled within the channel, the marker bar swingingly moving between a stored position parallel with the pole and an alternative extended position, the marker bar in the extended position forming an angle 90° or greater with the pole and configured to extend to a height proximal a nose of a football resting horizontally on the ground, a back side of the marker bar lying coplanar with the tangent plane at the point of union of the chain connector and the pole in both the stored position and the extended position.

2. The football yardage chain apparatus of claim 1 further comprising the top side and the bottom side of the unit housing being hemispherical and the middle portion being cylindrical.

3. The football yardage chain apparatus of claim 1 further comprising the marker bar being rectangular prismatic.

4. The football yardage chain apparatus of claim 3 further comprising a proximal end of the marker bar being rounded, the hinge being adjacent the proximal end.

5. The football yardage chain apparatus of claim 4 further comprising the hinge being coupled between a rear face and a front face adjacent a bottom face of the channel, the channel securing the marker bar between the rear face and the front face to require force to be moved between the stored position and the extended position.

6. The football yardage chain apparatus of claim 1 further comprising a distal end of the marker bar extending above the top side of the unit housing in the stored position.

7. The football yardage chain apparatus of claim 1 further comprising the chain connector having an extension coupled to the pole and an eyelet coupled to the extension.

8. The football yardage chain apparatus of claim 7 further comprising the eyelet being circular and having a diameter configured to allow the chain to move freely unless pulled taut.

9. A football yardage chain apparatus comprising:

a pole, the pole conforming to dimensions of a standard lead American football yardage marker pole;

a chain connector coupled to the pole, the chain connector having an extension coupled to the pole proximal a bottom end of the pole and extending perpendicularly from a tangent plane of an outer surface of the pole at a point of union of the chain connector and the pole, the chain connector having an eyelet coupled to the extension and being configured to couple to a chain coupled to a standard follow American football yardage marker pole, the eyelet being circular and having a diameter configured to allow the chain to move freely unless pulled taut:

a unit housing coupled to the pole, the unit housing having a top side, a bottom side, and a middle portion extending therebetween, the top side having a pole aperture extending through the bottom side and a channel extending through an inner side of the middle portion and the top side to the pole aperture from proximal the bottom side to the top side, the top side and the bottom side of the unit housing being hemispherical and the middle portion being cylindrical, the pole being coupled within the pole aperture such that the chain connector is between the unit housing and the bottom end of the pole; and a marker bar coupled to the unit housing, the marker bar being rectangular prismatic and having a hinge coupled through a rounded proximal end extending between a rear face and a front face adjacent a bottom face of the channel, the marker bar swingingly moving between a stored position parallel with the pole and an alternative extended position, a distal end of the marker bar extending above the top side of the unit housing in the stored position, the marker bar in the extended position forming an angle 90° or greater with the pole and configured to extend to a height proximal a nose of a football resting horizontally on the ground, the channel securing the marker bar between the rear face and the front lice to require force to be moved between the stored position and the extended position, a back side of the marker bar lying coplanar with the tangent plane at the point of union of the chain connector and the pole in both the stored position and the extended position.

10. A football yardage chain apparatus comprising:

a pole, the pole conforming to dimensions of a standard lead American football yardage marker pole;

a chain connector coupled to the pole, the chain connector having an extension coupled to the pole proximal a bottom end of the pole and extending perpendicularly from a tangent plane of an outer surface of the pole at a point of union of the chain connector and the pole, the chain connector having an eyelet coupled to the extension and being configured to couple to a chain coupled to a standard follow American football yardage marker pole, the eyelet being circular and having a diameter configured to allow the chain to move freely unless pulled taut:

a unit housing coupled to the pole, the unit housing having a top side, a bottom side, and a middle portion extending therebetween, the top side having a pole aperture extending through the bottom side, the top side and the bottom side of the unit housing being hemispherical and the middle portion being cylindrical, the pole being coupled within the pole aperture such that the chain connector is between the unit housing and the bottom end of the pole;

a marker laser coupled to the unit housing, the marker laser being coupled within the middle portion and having a lens extending through an inner side of the middle portion, the marker laser forming a planar laser grid coplanar with the tangent plane at the point of union of the chain connector and the pole;

a CPU coupled to the unit housing, the CPU being coupled within the middle portion and in operational communication with the marker laser, the CPU being configured to detect when the planar laser grid is broken by a nose of a football;

an alert system coupled to the unit housing, the alert system being coupled within the middle portion and in operational communication with the marker laser and the CPU, the alert system being activated by the CPU when the planar laser grid is broken to provide an audio and or visual cue to a user; and a battery coupled to the unit housing, the battery being coupled within the middle portion and in operational communication with the marker laser, the CPU, and the alert system.

* * * * *